US010597841B2

(12) United States Patent
Arntz et al.

(10) Patent No.: US 10,597,841 B2
(45) Date of Patent: Mar. 24, 2020

(54) FOUNDATION PILE INSTALLATION DEVICE

(71) Applicant: TECHNISCHE UNIVERSITEIT DELFT, Delft (NL)

(72) Inventors: Bernardus Johannes Maria Arntz, The Hague (NL); Nicolaas Michiel Noordam, Amsterdam (NL)

(73) Assignee: GBM Works B.V., The Hague (NL)

( * ) Notice: Subject to any disclaimer, the term of this patent is extended or adjusted under 35 U.S.C. 154(b) by 0 days.

(21) Appl. No.: 16/303,054

(22) PCT Filed: May 27, 2017

(86) PCT No.: PCT/EP2017/062717

§ 371 (c)(1),
(2) Date: Nov. 19, 2018

(87) PCT Pub. No.: WO2017/203023

PCT Pub. Date: Nov. 30, 2017

(65) Prior Publication Data

US 2019/0292745 A1 Sep. 26, 2019

Related U.S. Application Data

(60) Provisional application No. 62/341,214, filed on May 25, 2016.

(51) Int. Cl.
*E02D 5/72* (2006.01)
*E02D 7/18* (2006.01)
(Continued)

(52) U.S. Cl.
CPC ..... *E02D 13/005* (2013.01); *B06B 1/16* (2013.01); *E02D 5/24* (2013.01); *E02D 5/72* (2013.01); *E02D 7/18* (2013.01); *E02D 7/28* (2013.01); *E02D 13/00* (2013.01); *E02D 27/52* (2013.01); *B06B 2201/74* (2013.01); *E02D 27/525* (2013.01)

(58) Field of Classification Search
CPC .... E02D 5/72; E02D 7/18; E02D 7/24; E02D 7/26
USPC ..... 405/253
See application file for complete search history.

(56) References Cited

U.S. PATENT DOCUMENTS 3,645,345 A * 2/1972 Olsen ..... E02D 5/72 175/56
4,271,915 A * 6/1981 Bodine ..... E21B 7/24 175/105

(Continued)

FOREIGN PATENT DOCUMENTS

WO WO 2017/043709 * 3/2017

*Primary Examiner* — Frederick L Lagman
(74) *Attorney, Agent, or Firm* — Lumen Patent Firm

(57) ABSTRACT

A foundation pile end piece is provided that includes a ring-shape connection housing, where a proximal end of the ring-shape connection housing is configured to secure to a bottom end of a foundation pile, a moveable tip, where a distal end of the ring-shape connection housing is configured to fixedly hold the moveable tip, where the moveable tip is disposed to oscillate transversely with respect to a central axis of the ring-shape connection housing, where the moveable tip is configured to displace soil from the bottom end of the foundation pile according to actuation of the oscillation.

20 Claims, 11 Drawing Sheets

(51) Int. Cl.

| | |
|---|---|
| ***E02D 13/00*** | (2006.01) |
| ***B06B 1/16*** | (2006.01) |
| ***E02D 5/24*** | (2006.01) |
| ***E02D 7/28*** | (2006.01) |
| ***E02D 27/52*** | (2006.01) |

(56) References Cited

U.S. PATENT DOCUMENTS

| | | | | | |
|---|---|---|---|---|---|
| 4,403,665 | A * | 9/1983 | Bodine | E02D 7/18 | 175/394 |
| 4,527,637 | A * | 7/1985 | Bodine | E02D 7/18 | 175/107 |
| 4,615,400 | A * | 10/1986 | Bodine | E02D 7/18 | 175/107 |
| 2006/0021447 | A1 * | 2/2006 | Hecht | E02D 5/22 | 73/803 |
| 2012/0073107 | A1 * | 3/2012 | Koecher | E02D 7/30 | 29/428 |

* cited by examiner

FOUNDATION PILE INSTALLATION DEVICE

CROSS-REFERENCE TO RELATED APPLICATIONS

This application is a 371 of PCT application PCT/EP2017/062717 filed on May 25, 2017. PCT application PCT/EP2017/062717 claims the benefit of US Provisional application 62/341214filed on May 25, 2016.

FIELD OF THE INVENTION

The present invention relates generally to vibratory pile drivers. More particularly, the invention relates to increasing the penetration depth of a vibratory pile driver using a dynamic pile end piece that is capable of displacing ground material at the pile head end during the driving action.

BACKGROUND OF THE INVENTION

The most common foundation type in the offshore wind industry is the monopile. The foundation of a monopile is a large steel open-ended tube with diameters ranging from 2 to 16 meters, and wall thicknesses ranging from 5 to 20 centimetres. These foundation piles are installed into the ground with an impact hammer. The depth of installation typically ranges from 25 up to 40 meters into the ground. This depth is reached by striking the top of the pile with an impact hammer. By these strikes the pile penetrates the ground.

The impact hammer creates high noise levels underwater of up to 220 dB in the immediate proximity of the pile. Restrictions by several European governments have been stated on the level of this noise. The strictest regulations are the regulations stated by the German government, which allow a maximum noise level of 160 dB SEL (Sound Exposure Level) at 750 meters distance from the source. Other countries are expected to follow these requirements, which include The Netherlands, The United Kingdom, Denmark, Sweden, Norway and Belgium. In order to comply with these regulations, noise mitigation measures have to be taken. These countries have planned to install large amounts of wind turbines in the North Sea in the coming 15 years.

Several forms of noise mitigations have been developed and deployed since these regulations where stated. The most common used noise mitigations are a bubble curtain around the pile, which absorbs the sound produced by the hammer, and a noise mitigation screen, which is in fact a large round cofferdam in which the foundation pile is placed during installation, where this cofferdam is pumped dry so no direct contact between the water and the pile exist. Several other mitigation measures have been implemented, which all prevent the sound from propagating further into the water. These mitigation measures cost an average of three hundred thousand euros for each foundation pile installation. This is approximately 15% of the total foundation costs.

One attempt to not exceed the maximum sound level while installing a foundation pile includes using a vibratory hammer that is able to install a foundation pile to a certain depth without exceeding the maximum sound level. However the vibratory hammer is not capable of installing the pile to the required penetration depth of 25 to 40 meters deep. The depth which is typically reached with a vibratory hammer in the North Sea is anywhere between 5 and 20 meters. To reach the required depth an impact hammer is used after the use of a vibratory hammer. This once more requires the use of noise mitigation measures, therefore rendering this combination not profitable.

The soil resistance, which prevents the pile form penetrating the soil, has two components. The first is the resistance of the soil along the wall of the pile, outside and for an open ended steel pile also the inside. This resistance is called the 'shaft resistance' and is caused by the friction between the pile wall and the soil particles. The second is the resistance of the soil underneath the pile head end. When the pile penetrates the soil, the soil has to be pushed away to make room for the pile to enter. This resistance is called the 'tip resistance'. During vibratory driving in sand, the soil type commonly found in the North Sea, the shaft resistance is low compared to the tip resistance. Friction fatigue of the soil is considered responsible for this. A vibratory hammer typically vibrates with a frequency of 10 Hz to 30 Hz and with the amplitude of the pile and hammer, which are rigidly connected, of 0 to 10 millimetres in the vertical plane. During vibratory driving the soil around the shaft is shaken by these motions and the soil experiences a high number of loading cycles, up to $1\times10^5$ to $10\times10^5$ loading cycles are applied to the pile and soil around the pile during the time it takes to install the pile. These loading cycles cause fatigue in the soil. The frictional strength reduces by 80% to only 20% of its initial value. However the soil underneath the pile at the time of installation does not experience this large number of loading cycles because the pile enters new soil every time it penetrates further into the ground. Also, the shear strength of sand is, compared to other soil types such as clay, very high which in turn causes a high tip resistance in this type of soil. The combined shaft- and tip resistance of the pile during installation is the total resistance. The majority of this resistance, in hard sandy soils, such as the North Sea, is the tip resistance. This follows from pile driving predictions and measurements taken during pile installations with a vibratory hammer. What is needed is the reduction of the high tip resistance, where the pile could be installed to the full-required penetration depth with a vibratory hammer, while meeting noise reduction requirements.

SUMMARY OF THE INVENTION

To address the needs in the art, a foundation pile end piece is provided that includes a ring-shape connection housing, where a proximal end of the ring-shape connection housing is configured to secure to a bottom end of a foundation pile, a moveable tip, where a distal end of the ring-shape connection housing is configured to fixedly hold the moveable tip, where the moveable tip is disposed to oscillate transversely with respect to a central axis of the ring-shape connection housing, where the moveable tip is configured to displace soil from the bottom end of the foundation pile according to actuation of the oscillation.

According to one aspect of the invention, the actuation of the oscillation can include electromagnetic actuation, mechanical actuation, hydraulic actuation, electromechanical actuation, pneumatic actuation, or piezoelectric actuation.

In another aspect of the invention, the moveable tip includes a cone-shape moveable tip. Here, the actuation of the cone-shape moveable tip includes mechanical actuation, where the mechanical actuation includes an eccentrically weighted arm configured to oscillate the cone-shape moveable tip when operated on by motor-driven vibration, or hammering. In one aspect, the current embodiment further includes lubrication ports disposed proximal to the foundation pile bottom end, an outer wall of the cone-shape tip, or the foundation pile bottom end and the outer wall of the cone-shape tip, where the lubrication ports are disposed to output lubrication between soil and the cone-shape moveable tip, the foundation pile, or the cone-shape moveable tip and the foundation pile. Here, the lubricant can include fresh water, seawater, air, and mud. Further, the lubricant ports are disposed to output grouting after installation of the foundation pile. In another aspect the current embodiment further includes a load sensor and accelerometer, where the load sensor and accelerometer are disposed to measure a resistance force between the moveable tip and soil surrounding the moveable tip.

According to another aspect of the invention, the moveable tip includes an array of the moveable tips arranged around the ring-shape connection housing forming a closed circular moveable tip array at the foundation pile bottom end. In one aspect, the closed circular moveable tip array includes a plurality of moveable elements arranged around the closed circle, where a gap is disposed between the foundation pile and soil that is adjacent to the foundation pile according to soil displacement by the actuation of the array of moveable tips. Here, the current embodiment further includes lubricant ports proximal to the gap or the bottom end of the moveable tips, where the lubricant ports output lubricant to the foundation pile walls. In one aspect of the current embodiment, the lubricant can include fresh water, seawater, air, and mud. In another aspect, the lubricant ports are disposed to output grouting after installation of the foundation pile. In yet another aspect of the current embodiment, each moveable tip includes a spring loaded moveable tip, where each spring loaded moveable tip pivots about a separate axis that is tangential to the circumference of the ring-shape connection housing, where each moveable tip is configured to displace soil radially inward and radially outward with respect to the foundation pile bottom end. According to one aspect of the current embodiment, each movable tip is actuated by mechanical actuation, where the mechanical actuation includes a hammer driven cam arm configured to oscillate a spring loaded moveable tip. In another aspect of the current embodiment, each movable tip includes a self-oscillating moveable tip, where the self-oscillation includes an articulating arm connected to the ring-shape connection housing at a proximal end and a tip element connected to the articulating arm at a distal end, where the articulating arm includes a shape memory material, or the self-oscillation is actuated according to actuation selected from the group consisting of electromagnetic actuation, mechanical actuation, hydraulic actuation, electromechanical actuation, pneumatic actuation, and piezoelectric actuation. The current embodiment further includes lubricant ports disposed output lubricant to the foundation pile walls. Here, the lubricant can include fresh water, seawater, air, and mud. Further, the lubricant ports are disposed to output grouting after installation of the foundation pile.

According to one aspect of the invention, the moveable tip includes a force sensor, where the force sensor is configured to measure a soil resistance force along the tip.

To further address the needs in the art, a foundation pile end piece is provided that includes a connection housing, where the connection housing is fixedly connect to a foundation pile bottom end using connection actuators, where the connection actuators include actuators fixedly connected to an inner wall of the foundation pile, where the actuators are disposed to extend and retract radially with respect to the foundation pile inner wall, a movable tip, where the moveable tip includes a ring-shape tip having a diameter that is smaller than an inner diameter of the foundation pile, where the moveable tip is connected to the connection actuators, where the moveable tip is configured to move soil from the foundation pile bottom end during installation of the foundation pile according to operation of the actuators.

DETAILED DESCRIPTION

The current invention is directed to the installation of foundation piles. According to one embodiment, the invention facilitates the installation of foundation piles with or without the use of a vibratory hammer. By adding the invention to the bottom part of the pile, the soil is cut, scraped, and pushed away from the pile bottom end and displaced to the surrounding soil to eliminate or reduce the high tip resistance from underneath the pile. According to different embodiments of the invention, the moveable tip device is actuated by the motions generated by a vibratory hammer, electromagnetic actuation, mechanical actuation, hydraulic actuation, electromechanical actuation, pneumatic actuation, piezo electric actuation, thermally activated bimorph actuation, thermal expansion, shape memory materials, or chemical actuation configured to induce oscillations in a vertical direction. The oscillating vertical motions are transformed by the device underneath the foundation pile bottom end into lateral, rotating, or lateral and rotating motions of the scraper.

In another embodiment the lateral, rotating, or lateral and rotating motions of the scraper are directly induced by electromagnetic actuation, mechanical actuation, hydraulic actuation, electromechanical actuation, pneumatic actuation, piezo electric actuation, thermally activated bimorph actuation, thermal expansion, shape memory materials, or chemical actuation. The current invention enables penetration of the foundation pile into the soil according to the force of the weight of the foundation pile and possibly combined with the weight of the vibratory hammer.

The current invention is presented in two useful forms that include a cone-shape tip, and a ring-shape tip, where the cone shape tip has a single moveable tip, and the ring-shape tip has multiple moveable tips arrayed around the ring. According to one embodiment, the single cone-shape movable tip is useful for relatively small diameter foundation piles, for example less than approximately 1 meter. In another embodiment of the invention, the ring-shape movable tip is suitable for foundation piles having diameters greater than approximately 1 meter.

Figure 1A:
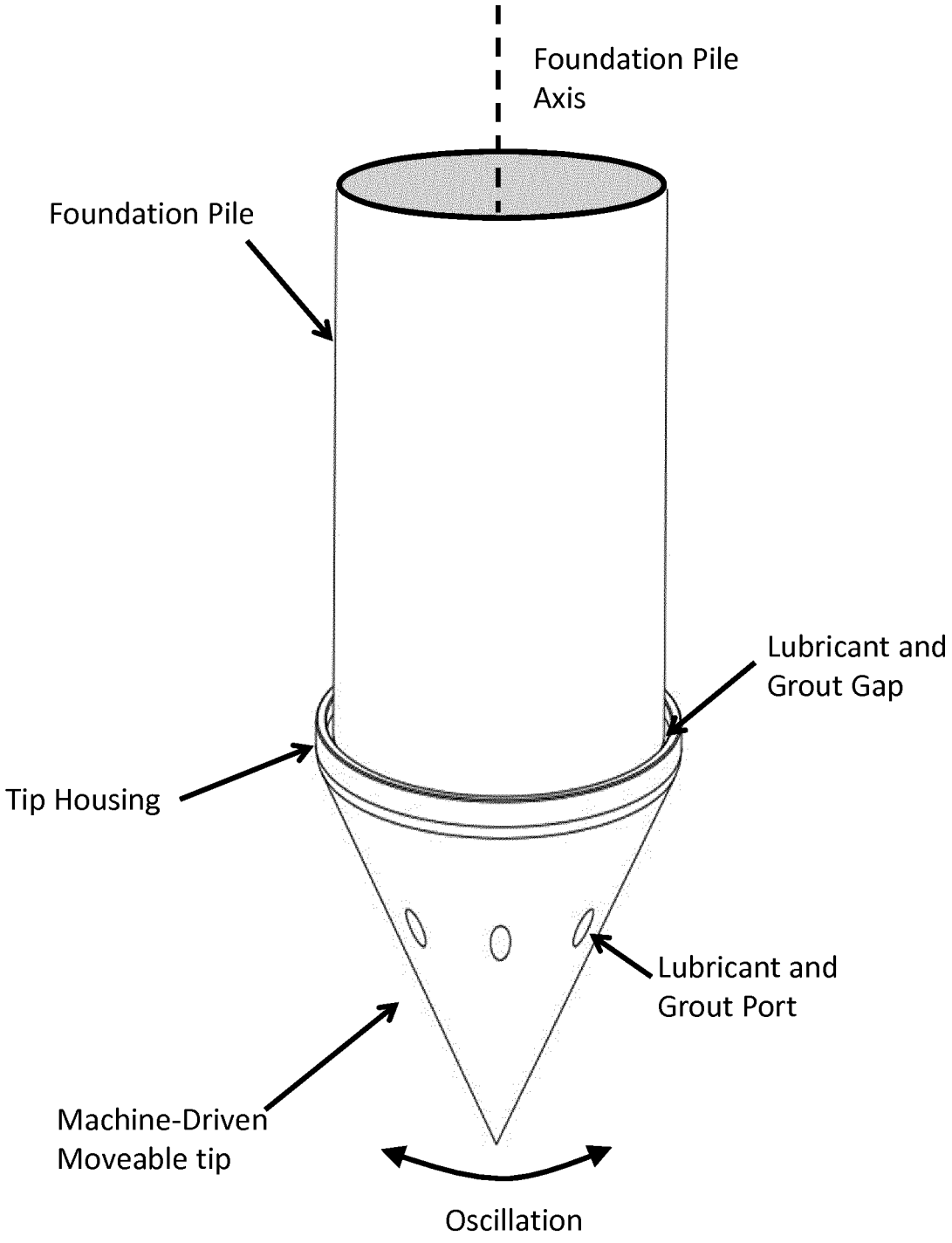
FIG. 1A-1B show schematic drawings of a machine-driven moveable tip attached to a bottom end of a foundation pile with lubrication disposed to reduce the pile wall friction, according to one embodiment of the invention.
Figure 1B:
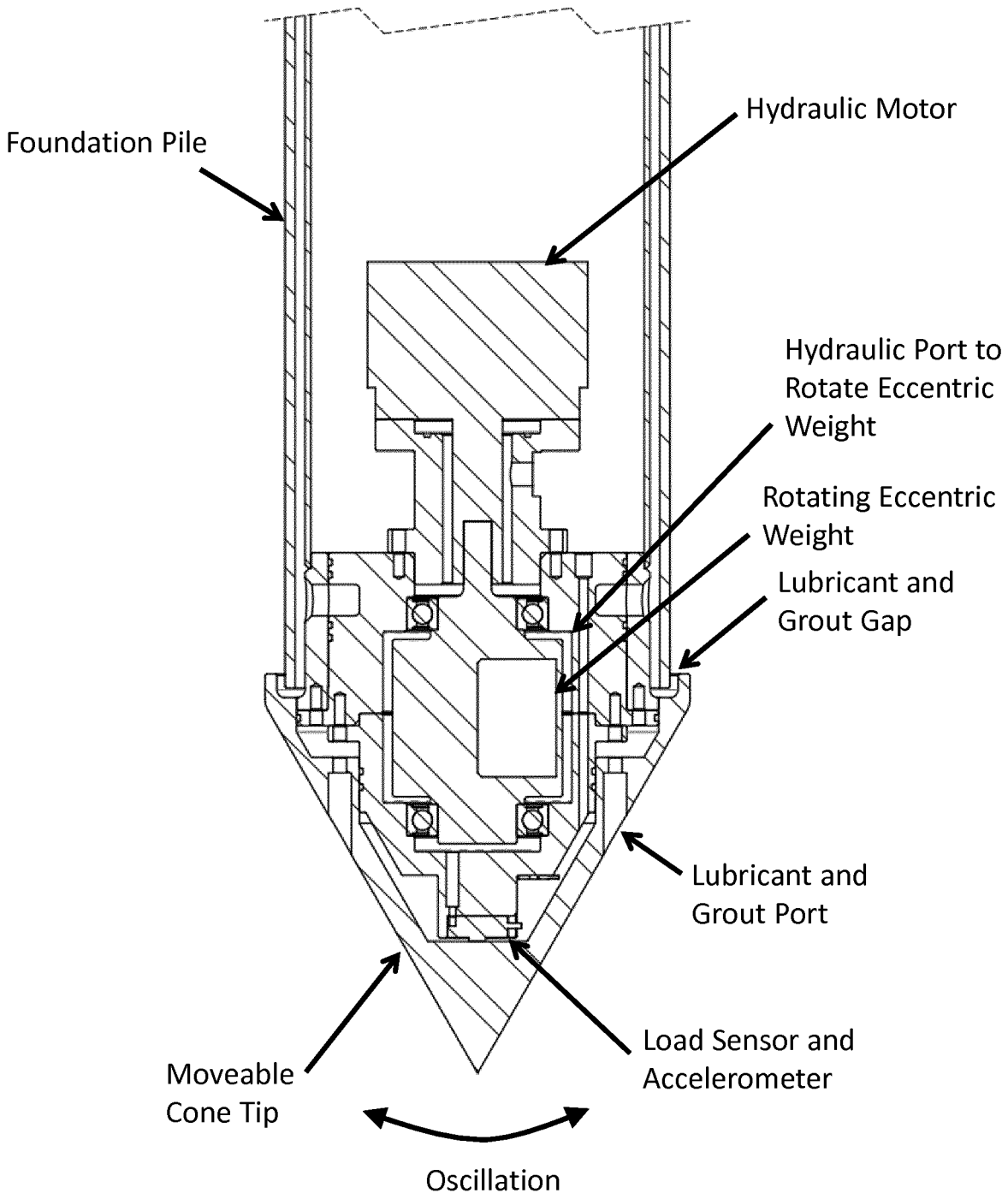

According to embodiments of the current invention, multiple variations of the devices can be connected to the bottom end of the foundation pile. FIGS. 1A-1B show schematic drawings of a machine-driven moveable tip attached to a bottom end of a foundation pile with lubrication and grout ports disposed to reduce the pile wall friction and solidify the foundation pile after installation. Here, the foundation pile end piece that includes a ring-shape connection housing configured to secure to a bottom end of a foundation pile, a moveable tip, where the ring-shape connection housing is further configured to fixedly hold the moveable tip, where the moveable tip is disposed to oscillate transversely with respect to a central axis of the ring-shape connection housing, where the moveable tip is configured to displace soil from the bottom end of the foundation pile according to actuation of the tip oscillation.

FIG. 1B shows a cone-shaped machine for a smaller diameter foundation. This machine is inserted into the bottom end of the foundation pile and attached to the inside wall of the foundation pile. This exemplary embodiment oscillates due to a rotating eccentric weight driven by a hydraulic motor. At the same time water is injected at the lubricant and grout gap between the cone and the foundation pile wall and/or through lubricant and grout ports in the cone. The vibratory movement of the tip is produced by the force of the rotating eccentric weight displacing the cone outwards. The load that is exerted by the rotation of the eccentric weight can be calculated by:

$$F_{eccentricweight}=m\cdot e\cdot\omega^2,$$

where:

m is the mass of the weight;

e is the eccentricity of the center of gravity of the weight with respect to its rotational axis; and ω is the rotational speed of the eccentric weight as actuated by the motor.

Regarding the ring-shape moveable tip embodiments, three exemplary variations are provided that include a ring-shaped array of elements that are oscillated by an additional vibratory hammer on top of the foundation, a ring-shaped array of self-oscillating elements, and a self-oscillating ring.

In one embodiment, the invention includes a plurality of moveable tips arranged in a circular pattern around the ring-shape connection housing forming an interconnected array of moveable tip devices in a circle, where the tip array has approximately the same diameter and wall thickness of the pile under which they are installed. As an example, the number of devices that are installed to form a closed circular array underneath time pile are determined as follows: number of devices equals the length of the inner circumference of the pile divided by the width of one device.

Figure 2A:
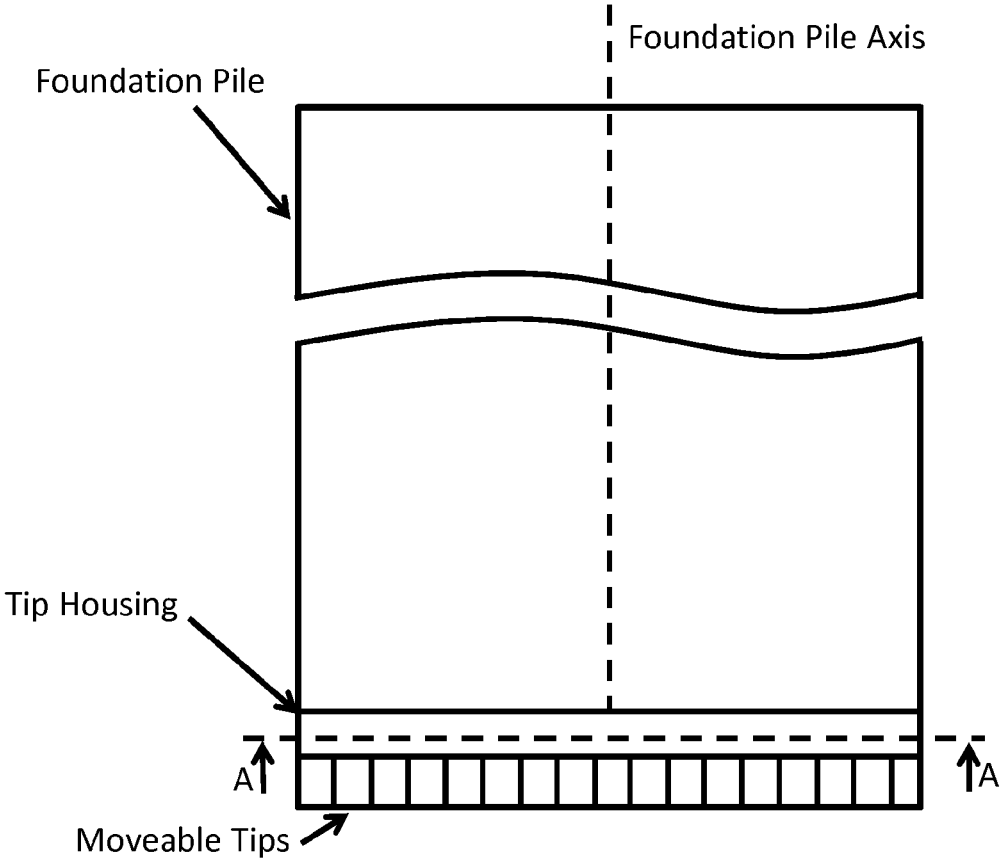
FIGS. 2A-2D show the moveable tips arranged in a circular array (2A, 2B), and planar views of the individual moveable tips (2C, 2D), according to embodiments of the current invention.

FIG. 2A shows a foundation pile, which is disposed to oscillate in vertical direction by application of a vibratory hammer to penetrate the soil. One embodiment of the moveable tip is shown positioned underneath the bottom end of the foundation pile. The moveable tips are held in place by the ring-shape housing. One moveable tip device covers a portion of the circumference of the pile, where multiple devices are attached underneath the pile to form circle of devices that can move independently of one another.

Figure 2B:
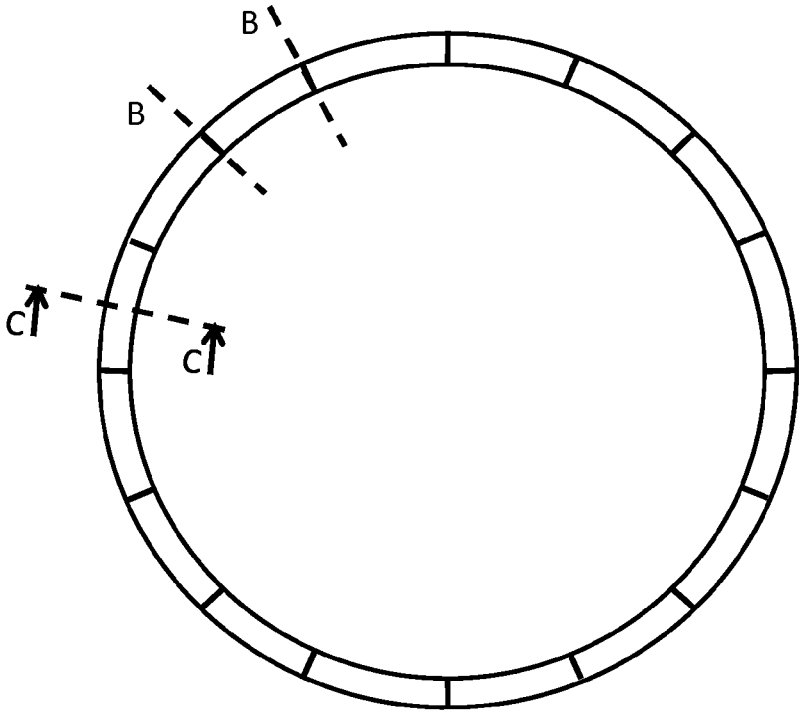

FIG. 2B shows a cross sectional view according to line AA of FIG. 2A. The multiple moveable tip elements are positioned underneath the foundation pile bottom end. The moveable tip elements are fixedly connected to the ring-shape housing.

Figure 2C:
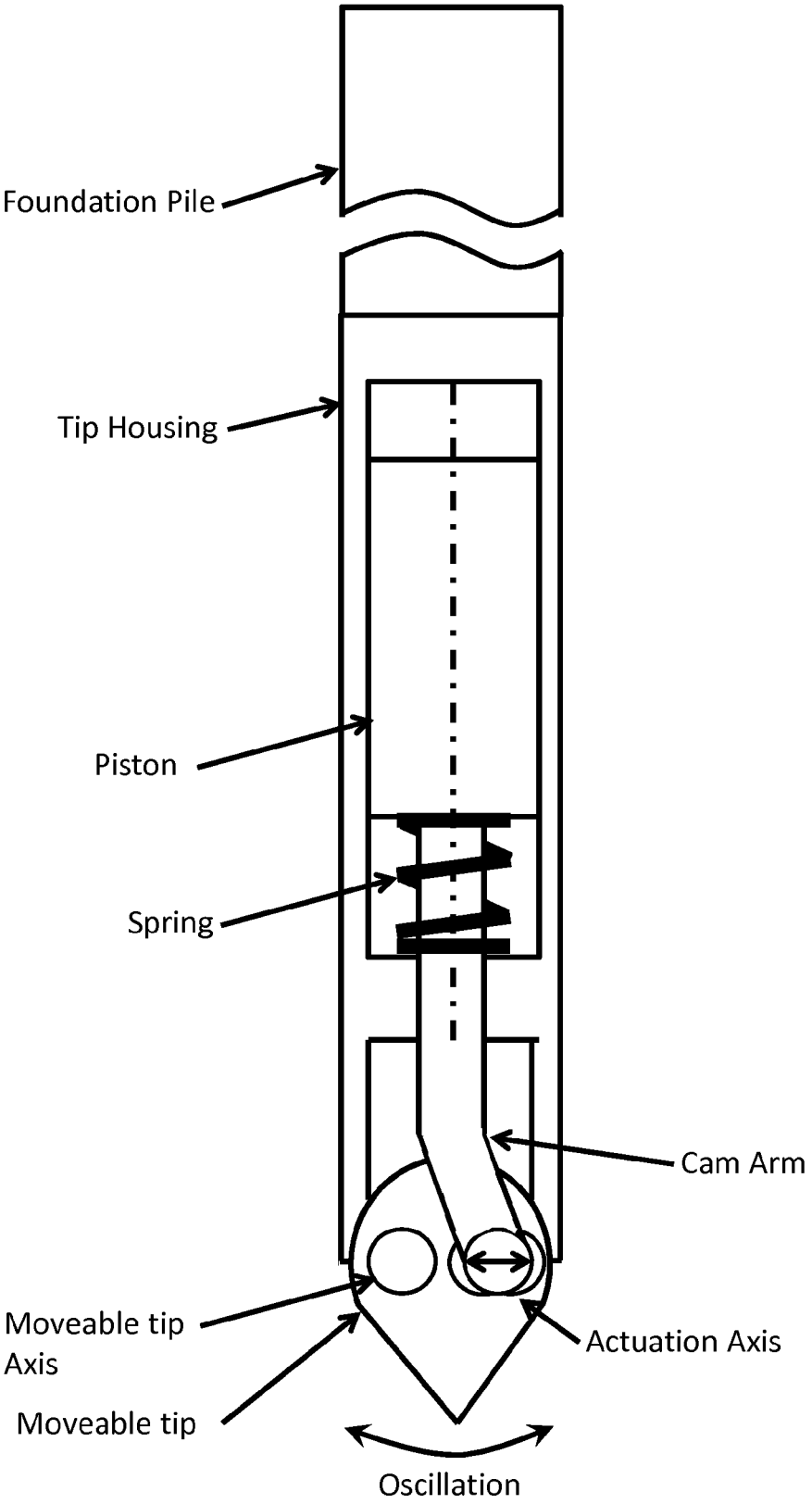

FIG. 2C shows a cross sectional view according to line CC of FIG. 2B. The moveable tip elements are configured to scrape, push and cut away the soil underneath the bottom end of the foundation pile to the surrounding soil in direction of the double arrow below the moveable tip. In this embodiment, the moveable tip rotates around the tip axis and is actuated by the piston, which is connected to the moveable tip by a cam arm and actuation axis. The rotating motion of the moveable tip is shown having a sharp end on the bottom part of moveable tip that does not extend further to the side than the outer edges of ring-shape housing. For example this oscillating motion can be in the range of −30 degrees to +30 degrees compared to the vertical neutral position. The actuation axis is attached to the moveable tip through a wide hole, which allows for motions in the vertical direction that in turn allow the oscillating motion of the moveable tip. The piston is actuated in the vertical direction by the vertical oscillating motion of the foundation pile.

Regarding the transfer of the vertical oscillating motion of the foundation pile to the oscillating motion of moveable tip, some exemplary ways of transferring the vertical oscillating motion to the transverse oscillating motion of the moveable tip include using a rigid direct connection, and by matching the moveable tip frequency to the applied frequency of the foundation pile driven by the vibratory hammer.

For the rigidly connected embodiment, the piston is rigidly connected to the foundation pile. The ring-shape housing is slidably fitted to the pile. By this loose connection the housing is capable of moving up and down in the vertical direction. When the foundation pile moves vertically up and down, a displacement of piston occurs according to the displacement of the pile. This displacement is not adopted by the housing, since it is not rigidly connected to pile, causing a rotating motion of moveable tip, which is connected to both the tip housing by the moveable tip axis and the piston by the actuation axis. The rotating motion of the moveable tip revolves around the moveable tip axis.

Regarding the vibrating at resonant frequency, the piston is not connected to the foundation pile, where the cam arm is connected to the movable tip by the moveable tip axis. In this example, the system formed by the piston, the moveable tip, the moveable tip axis, the actuation axis, the cam arm and spring are configured to have a matching frequency to the frequency applied to the foundation pile by the vibratory hammer. For example, this matching frequency is calculated with the combined masses of the piston, the moveable tip, the moveable tip axis, the actuation axis, the cam arm and the spring ($m_{total}$) and the spring constant of the spring ($k_{spring}$) and of the soil pressing against the moveable tip ($k_{soil}$) according to the following formula:

$$\text{own frequency}=\sqrt{\frac{k_{spring}+k_{soil}}{m_{total}}}.$$

In this example, the system resonates in its own frequency. The piston is guided by the housing. The spring balances the oscillating motions of the system, and prevents unwanted motions and accelerations.

Figure 2D:
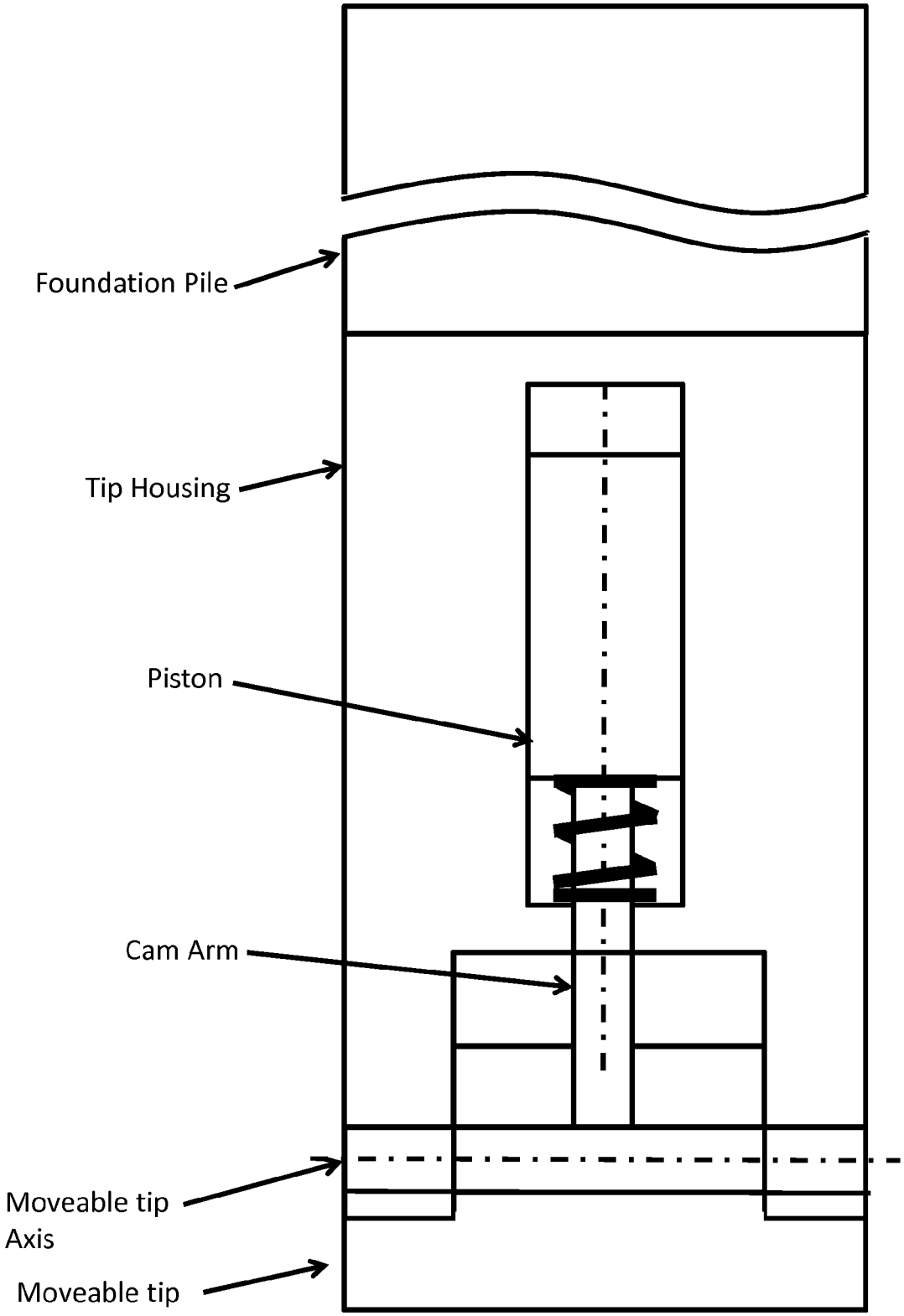

FIG. 2D is a cross sectional view according to line BB of FIG. 2B. As shown, the moveable tip spans the entire width of the tip housing. The moveable tip axis allows for the rotation of moveable tip in a direction transverse to the vertical oscillation of the foundation pile. The axis is held in place by the tip housing. The tip housing is connected to the bottom end of the foundation pile and to the adjacent tip housings on each side of the neighbouring devices to form the ring-shape housing.

Figures 3A, 3B:
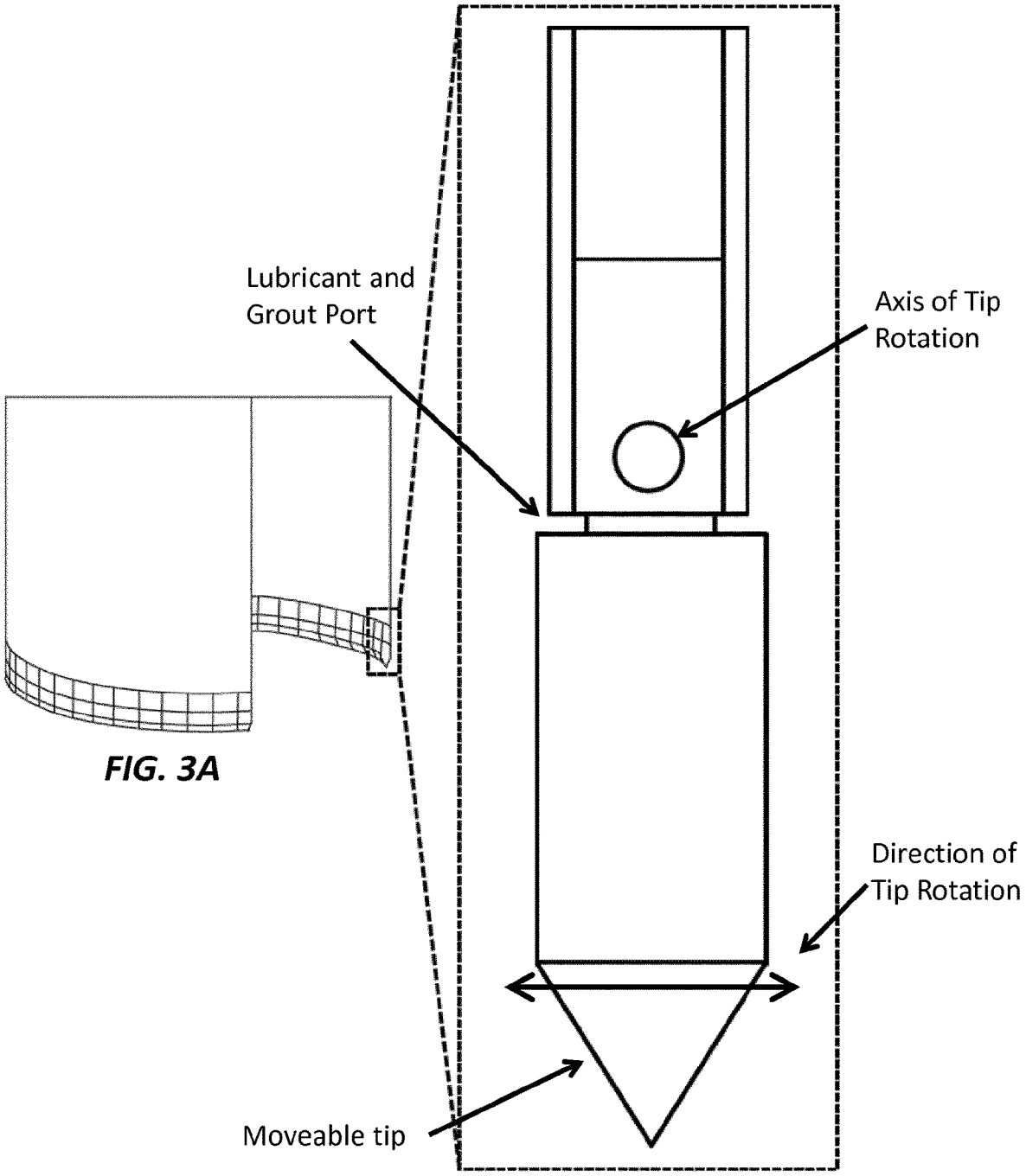
FIGS. 3A-3C show (3A) cross section of bottom part of hollow cylindrical pile with vibrating segments, (3B-3C) cross section views of individual vibrating elements in an array, according to one embodiment of the invention.
Figure 3C:
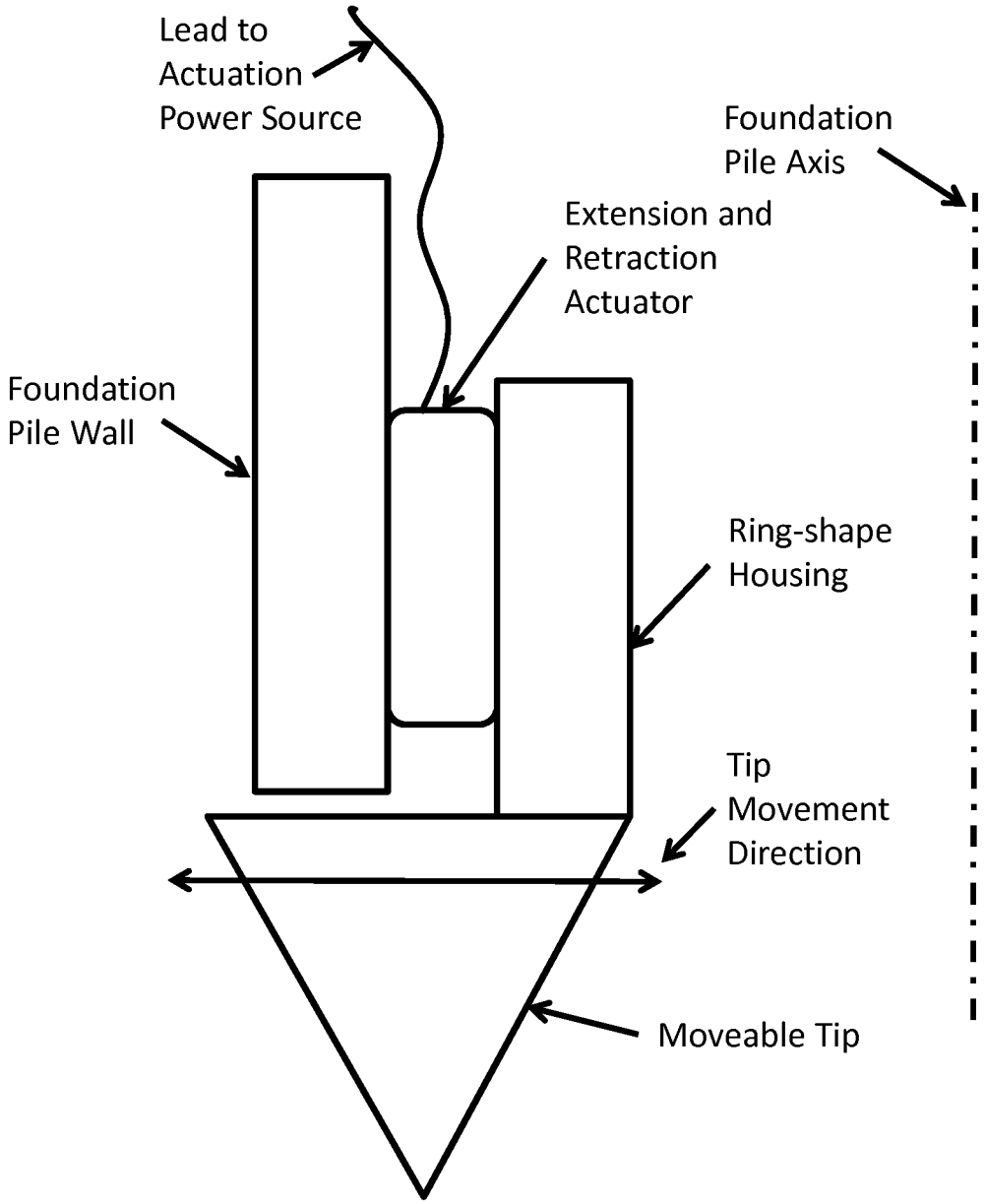

Turning now to a further embodiment of the current invention, where FIGS. 3A-3C show ring-shape embodiments of the current invention. In FIG. 3A, is a cross section view of bottom part of a hollow cylindrical foundation pile with a circular array of the moveable tips, and in FIG. 3B, a cross section of the cutaway line C-C of FIG. 2B, according to one embodiment of an individual moveable tip. As shown in the hash markings, the tip vibrations have a given frequency and amplitude at the foundation pile bottom end created by individual moveable tip segments, where the soil is scraped or pushed away with the moveable tip elements arranged in a circular array. In the current embodiment, the moveable tips are no longer excited by the vibratory hammer at the top of the foundation pile, but instead have their own actuation source for each individual segment, where some exemplary actuation sources can include electromagnetic actuation, mechanical actuation, hydraulic actuation, electromechanical actuation, pneumatic actuation, and piezoelectric actuation. In one aspect of the current embodiment, the moveable tip elements are wider than the wall thickness of the foundation pile. Because the moveable tip elements are wider than the wall thickness of the pile a gap is formed, where in the gap lubrication liquid is injected on both sides of the pile wall. In some examples the injection liquid can include fresh water, seawater or a form of lubricating mud such as bentonite. Here, the soil in the direct vicinity of the vibrating elements will be liquefied due to the moveable tip vibrations. According to further embodiments, electric cables are attached to the foundation pile to provide power for the actuators of the moveable tip elements. In another example, a number of tubes for the lubrication liquid can be installed over the length of the pile. Further, the frictional strength between the soil and pile wall will not be reduced by the vibratory hammer but by the lubrication injected at the bottom of the foundation pile.

FIG. 3C shows a cross section view of another embodiment of the invention, where the moveable tip is attached to the ring-shape housing, and the ring-shape housing is connected to the foundation pile wall by an actuator that can extend and retract, thus moving the tip in a direction that is transverse to the axis of the foundation pile.

Figure 4A:
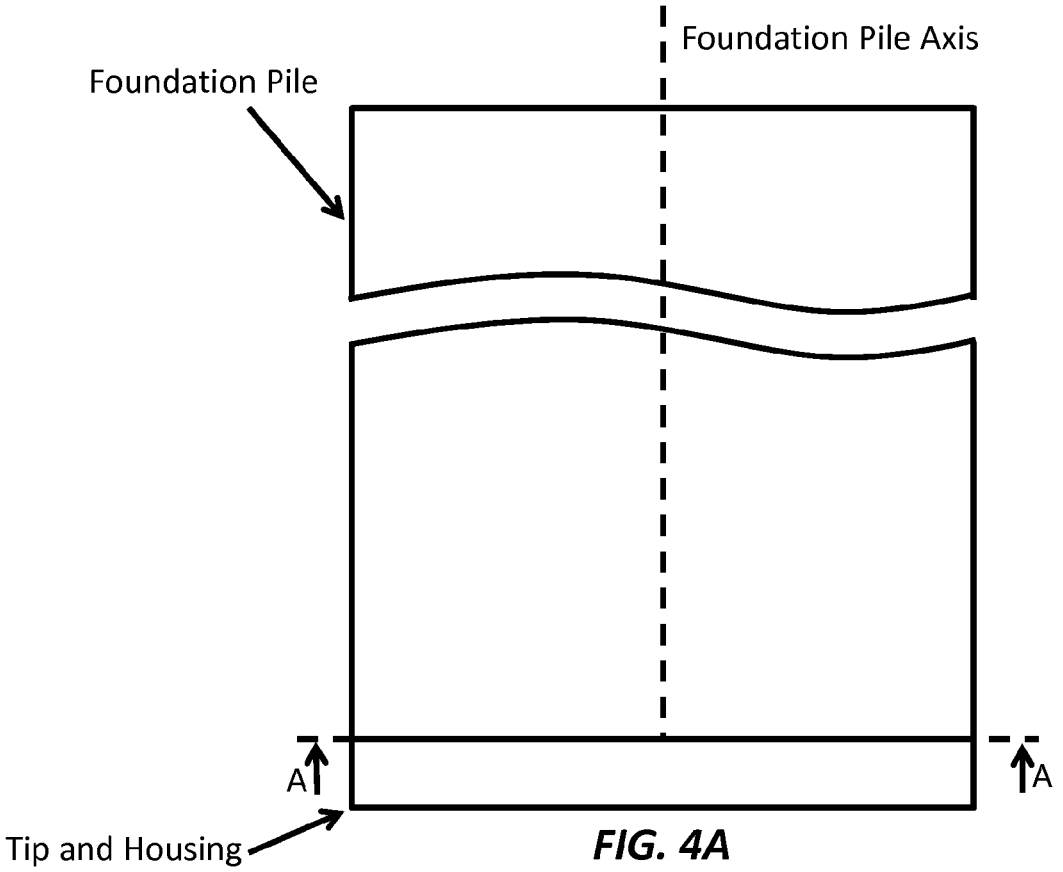
FIGS. 4A-4E show schematic views of a self-vibrating ring moveable tip, according to one embodiment of the invention.
Figure 4B:
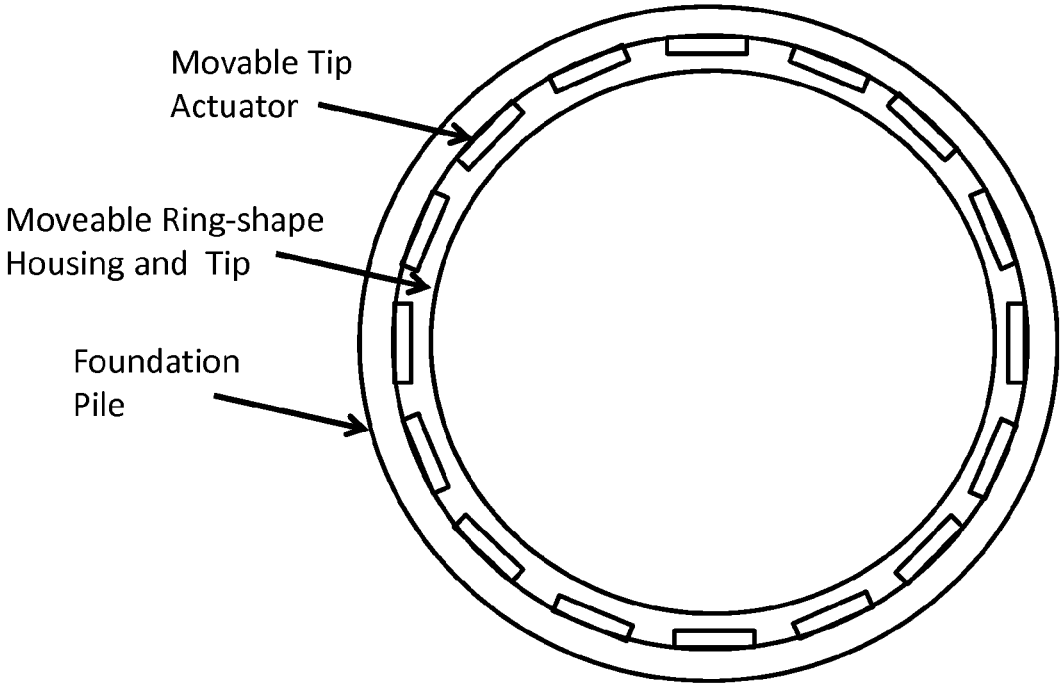
Figures 4C, 4D:
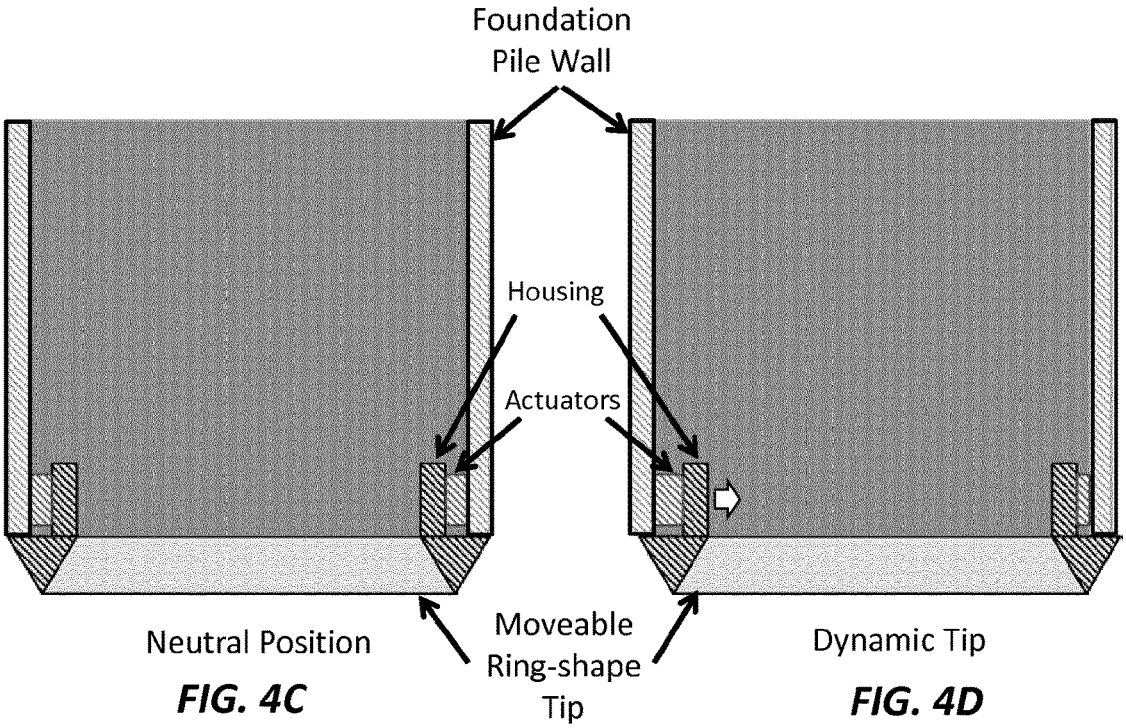
Figure 4E:
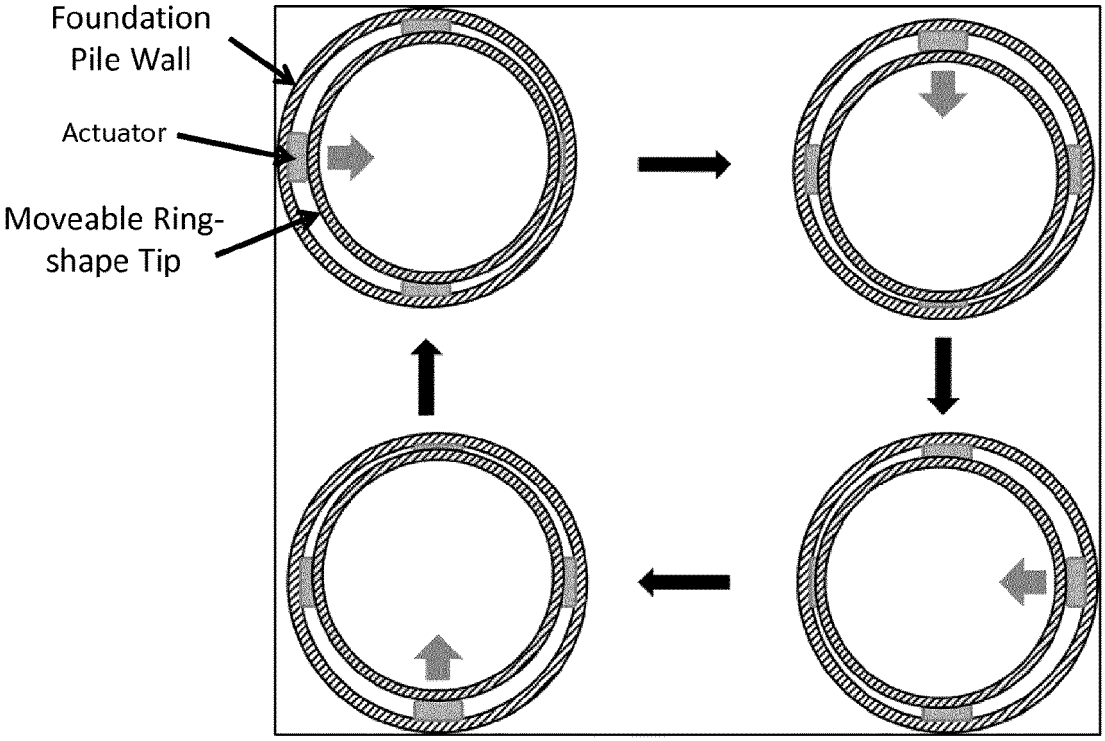

FIGS. 4A-4E show schematic views of a self-vibrating ring moveable tip, according to one embodiment of the invention. According to the current embodiment, the ring-shaped array of multiple moveable tips is replaced with a single ring-shape tip that is moved with respect to the foundation pile wall. Here, the ring itself is mounted to the ring-shape housing, and the ring-shape housing is mounted to the foundation pile wall via several extending and retracting actuators, where the ring-shape housing is fixedly attached to the ring-shape moveable tip. By alternating the extension and retraction of each actuator the ring can be vibrated in any direction. FIG. 4B shows a top view section view A-A (from FIG. 4A) of this embodiment. FIGS. 4C-4D show further cross section views of the current embodiment, where in FIG. 4C the machine is centered in a neutral position, and in FIG. 4D the actuators are shown to oscillate the machine. FIG. 4E shows an example of how the ring is oscillated with respect to the foundation pile by alternating the extension and retraction of the actuators around the ring.

Figures 5A, 5B:
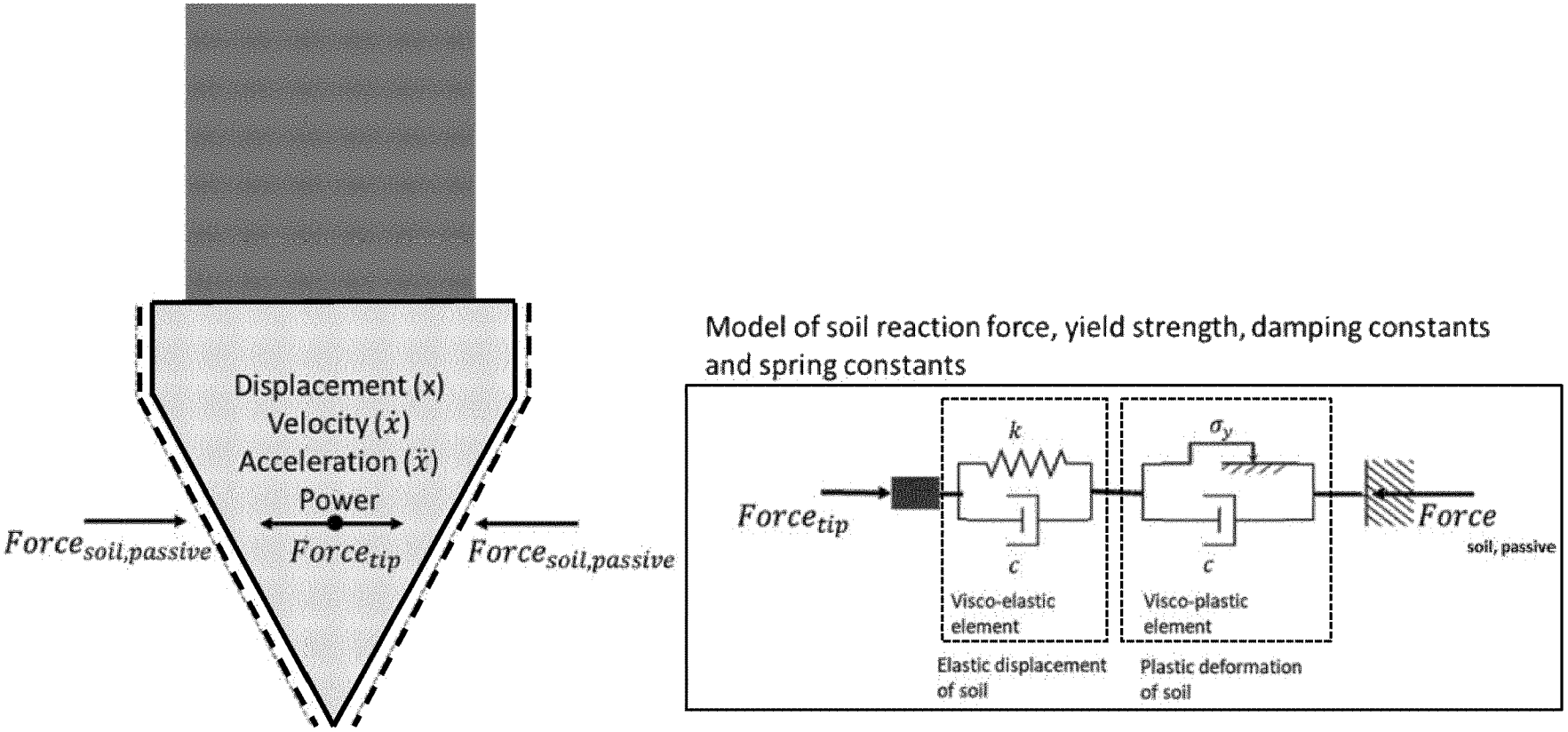
FIGS. 5A-5B show schematic drawings of a force sensor implemented to the moveable tip, according to one embodiment of the invention.

In a further embodiment of the invention, FIG. 5A shows a load sensor and accelerometer installed inside the moveable tip for measurements to be made of the soil while the foundation pile is penetrating therein, and FIG. 5B shows a model of the soil reaction force, yield strength, damping constants, and spring constants. The sensor measures the actuation force, the acceleration ($\ddot{x}$), velocity ($\dot{x}$) and displacement (x) of the oscillating tip. Thereby the soil-structure interaction is quantified and the spring (k), damping (c) and yield ($\sigma y$) characteristics of the soil can be quantified. With these characteristics the bearing capacity of the foundation pile can be determined; in particular the P-y characteristics, where P is the force needed to laterally move the pile a certain distance y. With these coefficients known the lateral bearing capacity of a foundation pile can be determined. For the visco-elastic element the following equation of motion applies: Force soil=$m\ddot{x}+c\dot{x}+kx$, where m=mass of the moveable tip+mass of affected soil;

c=damping coefficient of the soil;

k=spring coefficient of the soil;

Force soil=Force tip

Figure 6A:
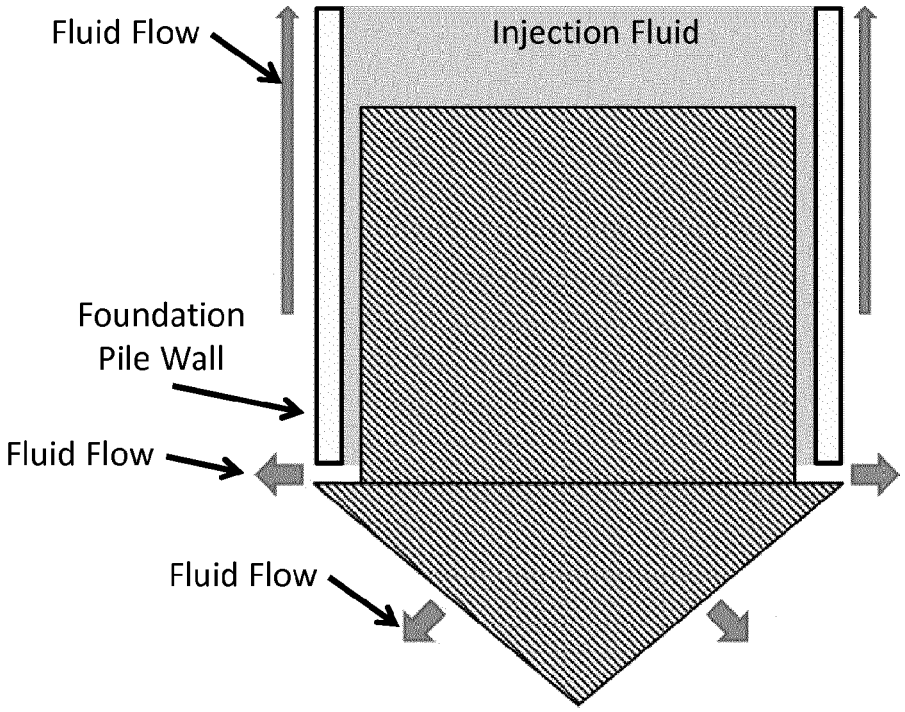
FIGS. 6A-6B show schematic drawings of the lubrication flow relative to the foundation pile and moveable tip machine, according to embodiments of the current invention.
Figure 6B:
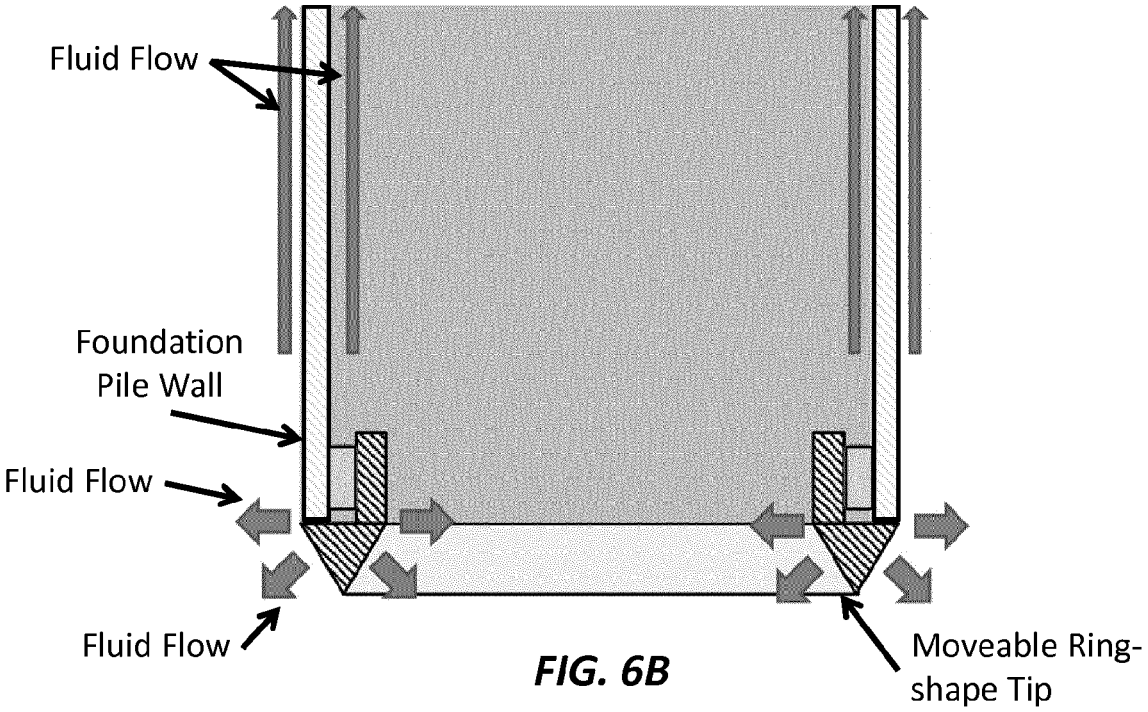

As discussed above, the fluid lubrication alleviates wall friction between the foundation pile wall and the surrounding soil. According to the current invention, the fluid is injected through the gap between the movable tip machine and the foundation pile and/or through nozzles in the cone. The fluid is disposed to flow upward along the outside of the foundation pile wall to reduce friction. FIGS. 6A-6B show schematic drawings of the lubrication fluid flow with respect to the foundation pile and moveable tip machine, according to embodiments of the current invention. Shown here, fluid is injected through nozzles in the ring-shaped machine, where the fluid is disposed to flow upwards on the inside and the outside of the foundation pile walls. After the foundation pile is installed, the fluid ports and channels are configured to flow grout therein to solidify in and about the foundation pile walls.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. All such variations are considered to be within the scope and spirit of the present invention as defined by the following claims and their legal equivalents.

What is claimed:

1. A foundation pile end piece, comprising:

a) a ring-shape connection housing, wherein a proximal end of the ring-shape connection housing is configured to secure to a bottom end of an open-ended tube foundation pile;

b) a moveable tip, wherein a distal end of said ring-shape connection housing is configured to fixedly hold said moveable tip, wherein said moveable tip is disposed to oscillate transversely with respect to a central axis of said ring-shape connection housing, wherein said moveable tip is configured to displace soil from the bottom end of said open-ended tube foundation pile according to actuation of said oscillation, and wherein said moveable tip comprises an array of said moveable tips arranged around said ring-shape connection housing forming a closed circular moveable tip array at said open-ended tube foundation pile bottom end.

2. The foundation pile end piece of claim 1, wherein said actuation of said oscillation is selected from the group consisting of electromagnetic actuation, mechanical actuation, hydraulic actuation, electromechanical actuation, pneumatic actuation, and piezoelectric actuation.

3. The foundation pile end piece of claim 1, wherein said moveable tip comprises a cone-shape moveable tip.

4. The foundation pile end piece of claim 3, wherein said actuation of said cone-shape moveable tip comprises mechanical actuation, wherein said mechanical actuation comprises an eccentrically weighted arm configured to oscillate said cone-shape moveable tip when operated on by motor-driven vibration, or hammering.

5. The foundation pile end piece of claim 3 further comprises lubrication ports disposed proximal to said foundation pile bottom end, an outer wall of said cone-shape tip, or said foundation pile bottom end and said outer wall of said cone-shape tip, wherein said lubrication ports are disposed to output lubrication between soil and said cone-shape moveable tip, said foundation pile, or said cone-shape moveable tip and said foundation pile.

6. The foundation pile end piece of claim 5, wherein said lubricant is selected from the group consisting of fresh water, seawater, air, and mud.

7. The foundation pile end piece of claim 5, wherein said lubricant ports are disposed to output grouting after installation of said foundation pile.

8. The foundation pile end piece of claim 3 further comprises a load sensor and accelerometer wherein said load sensor and said accelerometer are disposed to measure a resistance force between said moveable tip and soil surrounding said moveable tip.

9. The foundation pile end piece of claim 1, wherein said closed circular moveable tip array comprises a plurality of moveable elements arranged around said closed circle, wherein a gap is disposed between said foundation pile and soil that is adjacent to said foundation pile according to soil displacement by said actuation of said array of moveable tips.

10. The foundation pile end piece of claim 9 further comprises lubricant ports proximal to said gap or said bottom end of said moveable tips, wherein said lubricant ports output lubricant to said foundation pile walls.

11. The foundation pile end piece of claim 10, wherein said lubricant is selected from the group consisting of fresh water, seawater, air, and mud.

12. The foundation pile end piece of claim 10, wherein said lubricant ports are disposed to output grouting after installation of said foundation pile.

13. The foundation pile end piece of claim 1, wherein each said moveable tip comprises a spring loaded moveable tip, wherein each said spring loaded moveable tip pivots about a separate axis that is tangential to the circumference of said ring-shape connection housing, wherein each said moveable tip is configured to displace soil radially inward and radially outward with respect to said foundation pile bottom end.

14. The foundation pile end piece of claim 1, wherein each said movable tip is actuated by mechanical actuation, wherein said mechanical actuation comprises a hammer driven cam arm configured to oscillate a spring loaded moveable tip.

15. The foundation pile end piece of claim 1, wherein each said movable tip comprises a self-oscillating moveable tip, wherein said self-oscillation comprises an articulating arm connected to said ring-shape connection housing at a proximal end and a tip element connected to said articulating arm at a distal end, wherein said articulating arm comprises a shape memory material, or said self-oscillation is actuated according to actuation selected from the group consisting of electromagnetic actuation, mechanical actuation, hydraulic actuation, electromechanical actuation, pneumatic actuation, and piezoelectric actuation.

16. The foundation pile end piece of claim 1 further comprises lubricant ports disposed output lubricant to said foundation pile walls.

17. The foundation pile end piece of claim 16, wherein said lubricant is selected from the group consisting of fresh water, seawater, air, and mud.

18. The foundation pile end piece of claim 16, wherein said lubricant ports are disposed to output grouting after installation of said foundation pile.

19. The foundation pile end piece of claim 1, wherein said moveable tip comprises a force sensor, wherein said force sensor is configured to measure a soil resistance force along said tip.

20. A foundation pile end piece, comprising:

a) a connection housing, wherein said connection housing is fixedly connect to an open-ended tube foundation pile bottom end using connection actuators, wherein said connection actuators comprise actuators fixedly connected to an inner wall of said foundation pile, wherein said actuators are disposed to extend and retract radially with respect to said foundation pile inner wall;

b) a movable tip, wherein said moveable tip comprises a ring-shape tip having a diameter that is smaller than an inner diameter of said open-ended tube foundation pile, wherein said moveable tip is connected to said connection actuators, wherein said moveable tip is configured to move soil from said open-ended tube foundation pile bottom end during installation of said open-ended tube foundation pile according to operation of said actuators, and wherein said moveable tip comprises an array of said moveable tips forming a closed circular moveable tip array at said open-ended tube foundation pile bottom end.

* * * * *